US005679278A

United States Patent [19]

Cox

[11] Patent Number: 5,679,278

[45] Date of Patent: Oct. 21, 1997

[54] MICROWAVEABLE CONTAINER FOR LIQUID OILS

[76] Inventor: David H. Cox, 4001 Zenith Ave. North, Robbinsdale, Minn. 55422

[21] Appl. No.: 359,426

[22] Filed: Dec. 20, 1994

[51] Int. Cl.[6] ..... H05B 6/80

[52] U.S. Cl. ..... 219/730; 219/727; 99/DIG. 14; 426/107; 426/113; 426/234

[58] Field of Search ..... 219/730, 759, 219/727; 426/107, 109, 113, 241, 234, 243; 99/DIG. 14

[56] References Cited

U.S. PATENT DOCUMENTS

| | | | |
|---|---|---|---|
| 3,973,045 | 8/1976 | Brandberg et al. | 426/110 |
| 4,316,070 | 2/1982 | Prosise et al. | 219/10.55 |
| 4,450,180 | 5/1984 | Watkins | 426/107 |
| 4,705,707 | 11/1987 | Winter | 428/35 |
| 4,716,061 | 12/1987 | Winter | 428/35 |
| 4,878,765 | 11/1989 | Watkins et al. | 383/116 |
| 4,890,439 | 1/1990 | Smart et al. | 53/410 |
| 4,911,960 | 3/1990 | Mudge et al. | 428/34.3 |
| 4,943,456 | 7/1990 | Pollart et al. | 219/730 |
| 5,034,234 | 7/1991 | Andeas et al. | 426/107 |
| 5,057,359 | 10/1991 | Merdem et al. | 428/213 |
| 5,164,562 | 11/1992 | Huffman | 219/730 |
| 5,171,950 | 12/1992 | Brauner et al. | 219/730 |
| 5,175,404 | 12/1992 | Andreas et al. | 219/10.55 |
| 5,239,153 | 8/1993 | Beckett | 219/730 |
| 5,294,765 | 3/1994 | Archibald et al. | 219/727 |

*Primary Examiner*—Philip H. Leung
*Attorney, Agent, or Firm*—Moore & Hansen

[57] ABSTRACT

A microwaveable container is formed of a three part laminate structure including a middle layer of plastic impervious to liquid oils, water vapor, gas, and moisture, an inner layer of fibrous material joined to one side of the middle layer, and an outer fibrous layer joined to the other side of the middle layer. The seams are configured to enable the complete or essential prevention of leakage of oil, moisture, volatile flavoring agents, water vapor and oxygen through the container walls. Oils which are liquid at room temperature may be sealed and stored in the container without refrigeration to a temperature below the melting point of the oils.

51 Claims, 7 Drawing Sheets

MICROWAVEABLE CONTAINER FOR LIQUID OILS

BACKGROUND OF THE INVENTION

This invention relates generally to containers. More particularly, this invention pertains to microwaveable containers useful for heating various materials including foodstuffs, e.g. popcorn and the like.

Several problem areas have surfaced in the production, packaging, storage and use of microwaveable popcorn.

Past and present microwave popcorn packages have been constructed with materials which require the use of high melting point fats (ca. 100–108 degrees F.) that remain solid at most storage and distribution temperatures. These high melting point fats reduce the potential for wicking and bleeding through the container walls, seams and seals. Despite the use of high melting point fats, the present package constructions are prone to leaking, bleeding and wicking when the processing temperature of the melted fat exceeds specifications and when very hot oil (130+ degrees F.) or fat is deposited into the container in the filling process and when ambient temperatures of 90+ degrees F. are experienced for prolonged periods, as during hot summer weather.

Whether naturally highly saturated fats (e.g. cocoanut oil, palm oil or other lauric fats) or less saturated fats (e.g. soybean oil, cottonseed oil and other non-lauric fats) are used, they must be further saturated or hardened by hydrogenation to attain the high melting points of 100–108 degrees F. for use by manufacturers in microwave popcorn products. However, such oils have high concentrations of saturated fats and trans-fatty acids. As is well known, ingested saturated fats and trans-fatty acids adversely affect serum cholesterol levels and have been strongly linked as a causitive or contributory factor in coronary heart disease.

In addition, solidified oils having a melting point higher than the normal body temperature (98.6 degrees F.) produce an unpleasant "waxy" sensation called "drag" in the roof of the mouth.

Second, currently used packaging for microwaveable popcorn also permits the loss of moisture from the corn kernels through the container walls, resulting in poorer popping efficiency and less overall expansion. This is of especial significance with popcorns packages in which the normally added oil or fat is reduced or even eliminated. In such cases, even a slight loss of moisture from the kernels results in a propensity to burning rather than popping.

Third, current methods of packaging include heating of the solidified "saturated" oil to 115–130 degrees F. to melt the oil, and mixing it with the kernels. This preheating requires additional equipment and adds energy expense as well. In addition, the hazards of handling hot oil are well documented. This extra preheating of the corn kernels also results in moisture loss which reduces the expansion of the corn when popped.

Fourth, oxygen permeability of prior art packaging may result in degradative oxidation of the oil and flavorings.

Fifth, where a flavoring agent is added to the container to produce flavored popcorn, the prior art containers have not been consistently able to either seal the agent in the container, or seal oxygen out. As a result, the package may contain insufficient flavoring agent or may require the manufacturer to add extra flavoring agent to compensate for volatile flavor components lost due to the gas permeable nature of the container. As a result, the popcorn may be insufficiently flavored or costs for flavoring may be much higher than desired.

Sixth, some microwaveable popcorns are packaged with a reduced oil level, such as only 20–50% of the oil quantity normally used. However, this has the propensity to result in greater dehydration of the kernels, causing a loss in popping expansion and higher unpopped kernel count.

Seventh, overwrapping of present microwave popcorn containers with plastic film results in labor and costs associated with overwrap equipment and film, downtime resulting therefrom, and film losses.

The critical periods for leakage of a microwaveable container are during processing and storage, not during the short heating period. For example, oils which are liquid at room temperature are not used in microwaveable popcorn containers as they wick and leak through the paper from which the containers are constructed. The leakage results in product failure because seams and seals come apart, preventing bag inflation and causing burning and charring of the popcorn and the package. In addition, the package becomes completely soaked with grease or fat. All commercial microwaveable popcorn packages contain hydrogenated oils which are solid or semisolid at room temperature. Typically, a layer of so-called "grease-proof" paper is used to prevent wicking and leakage of the solidified oils through the package walls. In addition, a thin overcovering of thin plastic film is often used during storage to prevent the loss of moisture and volatile flavor components from the package, and is removed by the consumer before heating the inner microwaveable container. However, since the overwrap is outside of the package, moisture and volatiles escape from the inner container and fill or equilibrate with the head space produced by the overwrap. In frequent cases the overwrap is imperfectly sealed, permitting free external gas exchange between the container and the atmosphere. In some cases, manufacturers puncture the installed overwrap to release excess air and reduce the package size. In either case, the overwrap is rendered useless and is a complete waste.

A microwaveable container enabling the complete containment of low-saturation liquid oils at room temperatures and which is also nearly impervious to moisture, water vapor and gas transmission is needed to reduce the consumption of high-saturated oils or fats, enhance the quality of the popcorn or other product, simplify the manufacturing process, and reduce costs. It is also desirable to provide improvements to the microwave product industry which will eliminate oil heating and downtime related to oil solidifying in oil lines and depositing in equipment, simplify cleaning, and eliminate the need for overwrapping equipment and overwrap film. It is also desirable to eliminate the downtime and film waste associated with overwrapping of these containers.

BRIEF SUMMARY OF THE INVENTION

The primary object of this invention is to produce an improved microwaveable container which is impermeable to liquid oils, moisture and water vapor.

A further object is to produce a container which is also essentially impermeable to oxygen and other gases.

A secondary object of this invention is to eliminate the necessity to use oils containing high contents of saturated fats in microwaveable popcorn packages.

Another object of this invention is to devise a microwaveable container which will sealably contain, without wicking or leakage, a liquid low-saturated or unsaturated oil without refrigeration to below the softening or melting point of the oil.

An additional object of this invention is to produce a microwaveable container which is specifically beneficial for containing food materials having no added fats or oils and thus are more sensitive to oxidation and/or moisture loss and/or product loss due to evaporation.

A further object of the invention is to produce a microwaveable popcorn container which will not become visibly or tactilly greasy during storage and preparation and will not require a plastic gas/vapor barrier overwrap.

An additional object of the invention is to eliminate the hazards of handling preheating oils in the packaging lines for microwaveable popcorn and other foodstuffs.

An associated object is to produce a system whereby packaging of microwaveable popcorn is conducted without preheating of the oil to make it flowable.

A further object of the invention is to reduce the energy consumption of packaging microwaveable popcorn.

Another object of the invention is to produce a container which will extend the shelf life of microwaveable popcorn.

An object of the invention is to produce a system which requires much less oil or fat in the microwaveable popcorn packages but retains a high degree of expansion and reduced burning.

An additional object of the invention is to reduce the popping time of microwaveable popcorn.

Another object of the invention is to produce a microwaveable popcorn package in which a higher percentage of the corn is popped and the expansion is enhanced.

A further object of the invention is to reduce the moisture loss during storage of microwaveable popcorn, thus enhancing the total expansion and reducing the percentage of duds.

A further object of the invention is to make a microwaveable container which is useful for containing fats and oils at any degree or hydrogenation.

An additional object is to produce a microwaveable container which is adaptable to other foodstuffs and other materials in addition to popcorn.

An object of the invention is to produce an improved oil impervious and moisture impervious microwaveable container using existing container forming equipment.

The invention comprises a microwaveable container which includes a continuous or nearly continuous layer impervious to liquid oils, water vapor and moisture. The invention also includes a blank which may be filled with product and sealed to form a filled container. Methods for forming the blank and the container are also encompassed by the invention.

For purposes of this application, liquid oils are defined as oils which are unsolidified at normal household temperatures, i.e. about 60–80 degrees F. More particularly, the liquid oils of principle application are the unhydrogenated, largely unsaturated oils including canola oil, corn oil, safflower oil, sesame oil, soybean oil, cottonseed oil and sunflower oil.

The above recited objects and other advantages of the invention will be readily understood by reading the following description in conjunction with the accompanying figures of the drawings wherein like reference numerals have been applied to designate like elements throughout the several views.

DESCRIPTION OF THE ILLUSTRATED EMBODIMENTS

Figure 1:
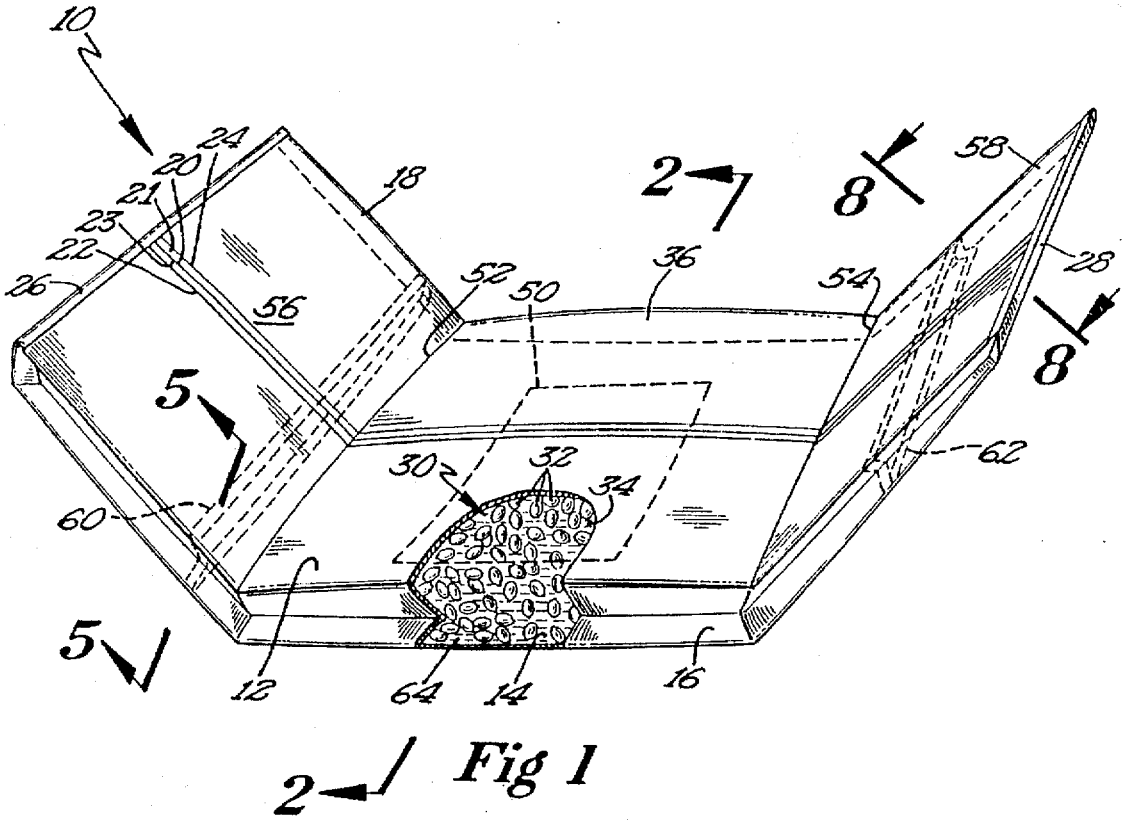
FIG. 1 is a perspective view of a microwaveable container of the invention.
Figure 2:
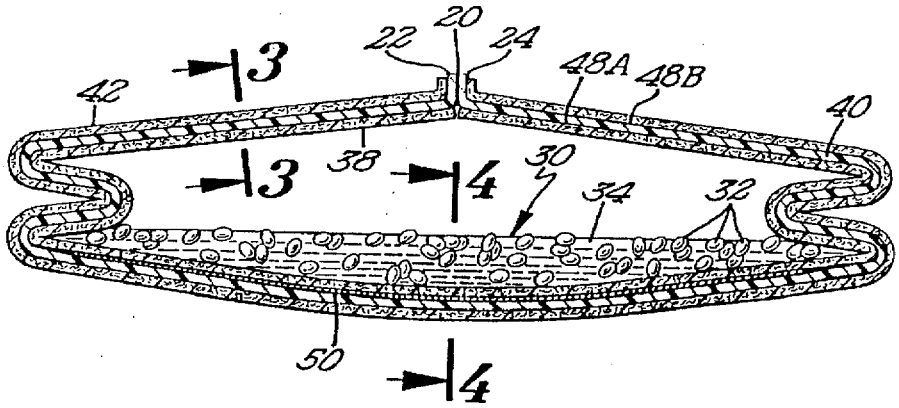
FIG. 2 is a cross-sectional transverse view through the central portion and load of a microwaveable container of the invention, as taken along line 2—2 of FIG. 1.

With reference to the drawings, and particularly to FIGS. 1 and 2, an embodiment of a microwaveable container 10 is depicted as a bag with laminar walls 12 and 14 having longitudinal gussets 16 and 18 on each side, providing substantial expansion volume. For purposes of illustration, some of the dimensions are exaggerated. The container 10 is shown with a longitudinal seam 20 at which longitudinal edge portions 21 and 23 adjacent longitudinal edges 22 and 24 are joined together. The container 10 is shown folded along first transverse seam 52 and second transverse seam 54 to form a first end portion 56, a second end portion 58 and a central portion 36. Sidewalls 12 and 14 are joined at each of the first and second ends 26 and 28 to seal the container 10.

A cutaway portion of the container 10 reveals an exemplary load 30 comprising, in this case, a plurality of popcorn kernels 32 and liquid oil 34 in the central portion 36 of the container. A microwave energy susceptor 50 is shown in the central portion 36 underlying the load 30. The susceptor 50 is preferably not in direct contact with the popcorn or other food product so as to prevent overheating of the susceptor 50 or packaging material resulting in thermal breakdown, i.e. charring, burning or vaporization thereof. Such degradation will produce adulteration/contamination of the load 30, making the load unappetizing or inedible.

Figure 5:
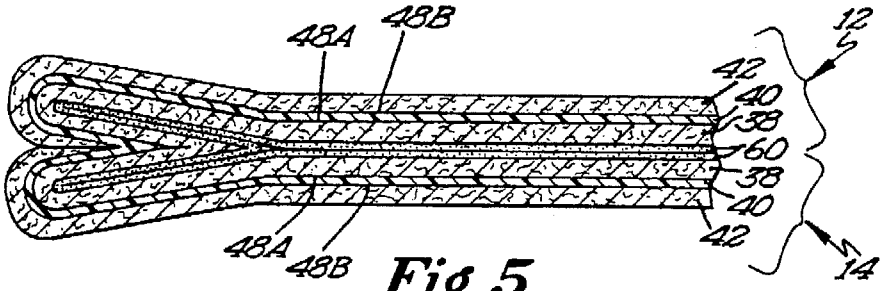
FIG. 5 is an enlarged cross-sectional partial view of the wall structure of a microwaveable container of the invention, as taken along line 5—5 of FIG. 1.

Also shown in FIG. 1 are transverse adhesion strips 60 and 62 which will be further described with respect to FIG. 5.

Figure 4A:
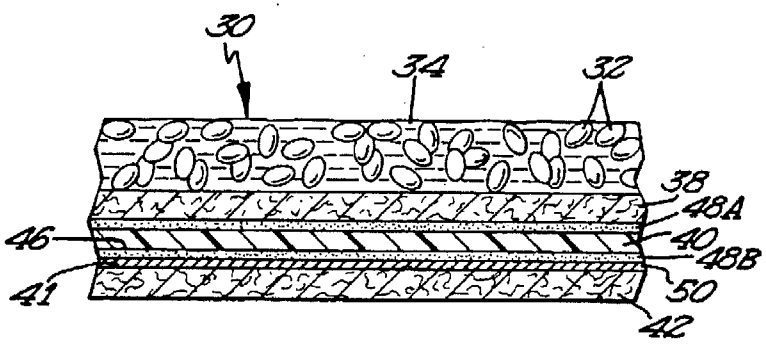
FIG. 4A is an enlarged cross-sectional view of the wall of another embodiment of the microwaveable container of the invention, as taken along line 4—4 of FIG. 2.
Figure 3:
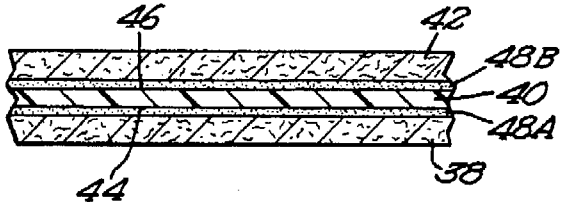
FIG. 3 is an enlarged cross-sectional view of the wall of a microwaveable container of the invention, as taken along line 3—3 of FIG. 2.
Figure 4:
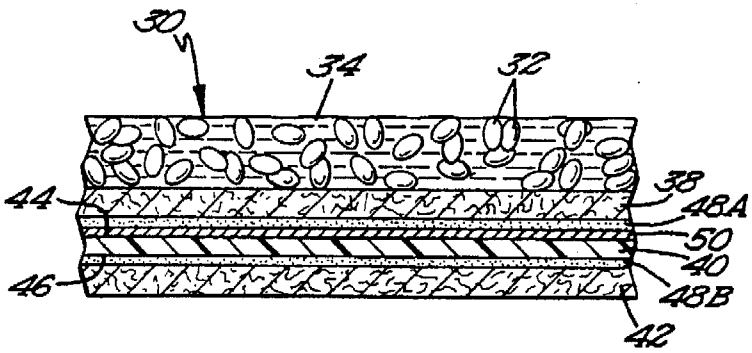
FIG. 4 is an enlarged cross-sectional view of the wall of a microwaveable container of the invention including an in-wall receptor and a load, as taken along line 4—4 of FIG. 2.

The construction of the walls 12 and 14 is shown in FIGS. 2, 3 and 4 as comprising three distinct layers joined with an adhesive 48. An inner layer 38 is joined to the interior face 44 of middle layer 40, the latter being impervious to liquid oil 34, water vapor, oxygen and moisture. The inner face 41 of an outer layer 42 abuts the exterior face 46 of the middle layer 40.

The middle layer 40 may be formed of polyester, such as Mylar polyethylene terephthalate (a trademark of E. I. dupont de Nemours and Company) or other plastic or non-plastic material which is impervious to liquid oils and moisture. The material of the middle layer 40 must also be resistant to microwave energy and the high temperatures produced thereby. Polyester materials such as Mylar work very well in this application, being impervious to liquid oils, moisture, water vapor, oxygen and flavoring agents such as are used in popcorn. Mylar and other polyester materials are also readily available in rolled film forms at reasonable cost. Typically, polyester film thicknesses of about 0.0005 to 0.002 inch are optimal.

The inner layer 38 may be formed of so-called "grease proof" paper as used in prior art popcorn bags. This paper is made relatively resistant to wicking of hardened oils by calendaring or other methods to make it less porous. However, "grease proof" paper is not impervious to liquid oils, moisture or oxygen. Other fibrous materials, such as kraft paper, may be alternatively used as the inner layer 38 of this invention. The inner layer 38 acts to insulate the load 30 from the middle layer 40 and from a microwave sensitive susceptor 50, if such is used. Direct contact of a load 30 with a plastic such as polyester film during the microwaving step may result in burning and/or physical breakdown of the film at the contact point, thereby contaminating/adulterating the load 30. Likewise, direct contact of a load 30 with a hot susceptor 50 may overheat the load. The inner layer 38 for a popcorn container 10 may typically be a calendered kraft paper with a weight of about 5–30 pounds per ream, based on 3000 square feet per ream, although paper of lighter or heavier weight may be used.

The outer layer 42 acts as a heat insulator to protect a user from being burned during handling. It is typically formed of kraft paper or other fibrous material which also adds stiffness to the container 10.

The inner layer 38 may be joined to the interior face 44 of the middle layer 40 by a continuous or discontinuous layer of adhesive 48A. The adhesive 48A may be a resin based emulsion type material such as Elektromek vinylacetate copolymer adhesive supplied by the Elektromek Company, Carlstadt, New Jersey, or a thermosetting polyvinyl acetate resin-based emulsion adhesive sold by Franklin International, Inc., Columbus, Ohio under the tradename Durocet. While the drawings show the layer of adhesive 48A between the inner layer 38 and the middle layer 40 to be continuous, this may not be necessary in every case. For example, the adhesive 48A may alternatively be applied in various patterns, sprayed in spaced spots, tacked, applied to any or all of the peripheral edge portions only, or otherwise applied discontinuously. For the purpose of this application, "edge portion" is defined as a narrow portion of the layer surface adjacent the edge.

The susceptor 50 may be any member which becomes heated when subjected to microwave radiation. Generally, the susceptor 50 comprises a thin layer of aluminum or other non-ferrous metal which has been vapor deposited or vacuum deposited by prior art methods directly onto the interior face 44 of the middle layer 40. Alternatively, a thin film of susceptor material may be adhesively attached to the middle layer 40 to form the susceptor 50. It should be noted that alternatively, the susceptor 50 is located on the exterior face 46 of the middle layer 40 and heat from the susceptor 50 passes through the middle layer 40 and inner layer 38 to the load 30.

For certain applications, such as where the load is not heated to temperatures sufficient to affect the physical integrity of the susceptor 50, the inner layer 38 may be made discontinuous or eliminated entirely, permitting direct contact of the susceptor 50 with the load 30.

Of course, a single container 10 may contain more than one susceptor 50. In addition, the susceptor(s) may be located in position(s) other than that shown in the figures, depending upon the container shape and where the heat is best applied to the particular lead. In some cases, a susceptor may not be required at all, simplifying the container construction.

It is understood that optionally, the susceptor 50 may be applied as in the prior art to the inner layer 38, which is then attached to the middle layer 40 by adhesive. In this mode of manufacture, the susceptor 50 may be on either side of the inner layer 38, but is preferably on the exterior side of the inner layer, that is, facing the middle layer 40, when the lead may be burned by direct exposure to the hot susceptor 50.

Alternatively, the susceptor 50 may be applied to the exterior face 46 of the middle layer 40, or to the interior face 41 of the outer layer 42, as shown in FIG. 4A.

The outer layer 42 is joined to the exterior face 46 of the middle layer 40 by a layer of adhesive 48B. Adhesive 48B may be identical to adhesive 48A or may differ. The primary purpose of the outer layer 42 is to act as an insulative stiffener, and continuous adhesion is not generally required. Thus, the adhesive 48B may be continuous or discontinuous. The middle layer 40 typically has little stiffness or rigidity, qualities which are provided by the outer layer 42 and the inner layer 38. For a microwaveable popcorn container, the weight of the outer layer may vary from about 5 to 30 pounds per ream (based on 3000 square feet per ream).

As shown in FIGS. 1 and 5, transverse adhesion strips 60, 62 are shown as substantially sealing the first and second end portions 56, 58 from the central portion 36 of the container 10. These strips 60, 62 comprise a narrow application of adhesive across the inside surface 64 of the end portions 56, 58 of the container 10, at or near the transverse seams 52, 54. The adhesion strips 60, 62 may be formed by spraying or extrusion of adhesive onto the inside surface 64. Alternately, the adhesive may be applied by rollers or drum, as is known in the prior art. The adhesive in strips 60, 62 adheres to the inside surface 64 which is typically the face of the inner layer 38, and adheres to itself when the container blank is folded to form the container 10. The adhesion strips 60, 62 hold the walls 12 and 14 together on each side of the central portion 36, compressing the load 30 therein to prevent the load from shifting in position. This is particularly useful in the case of popcorn where movement of kernels and/or oil from the susceptor area is undesirable. The adhesion strips 60, 62 may comprise a resin base adhesive in an emulsion form, or an equivalent. Exemplary adhesives are polymeric emulsion based adhesives such as previously described. For popcorn containers 10, a preferred adhesive for forming the adhesion strips 60, 62 is impervious to liquid oil, water vapor, flavorings, oxygen and moisture during storage at ambient temperatures. The adhesive softens and melts or weakens at microwaving temperature, releasing to permit the popped corn to expand into the end portions 56, 58.

Figure 6:
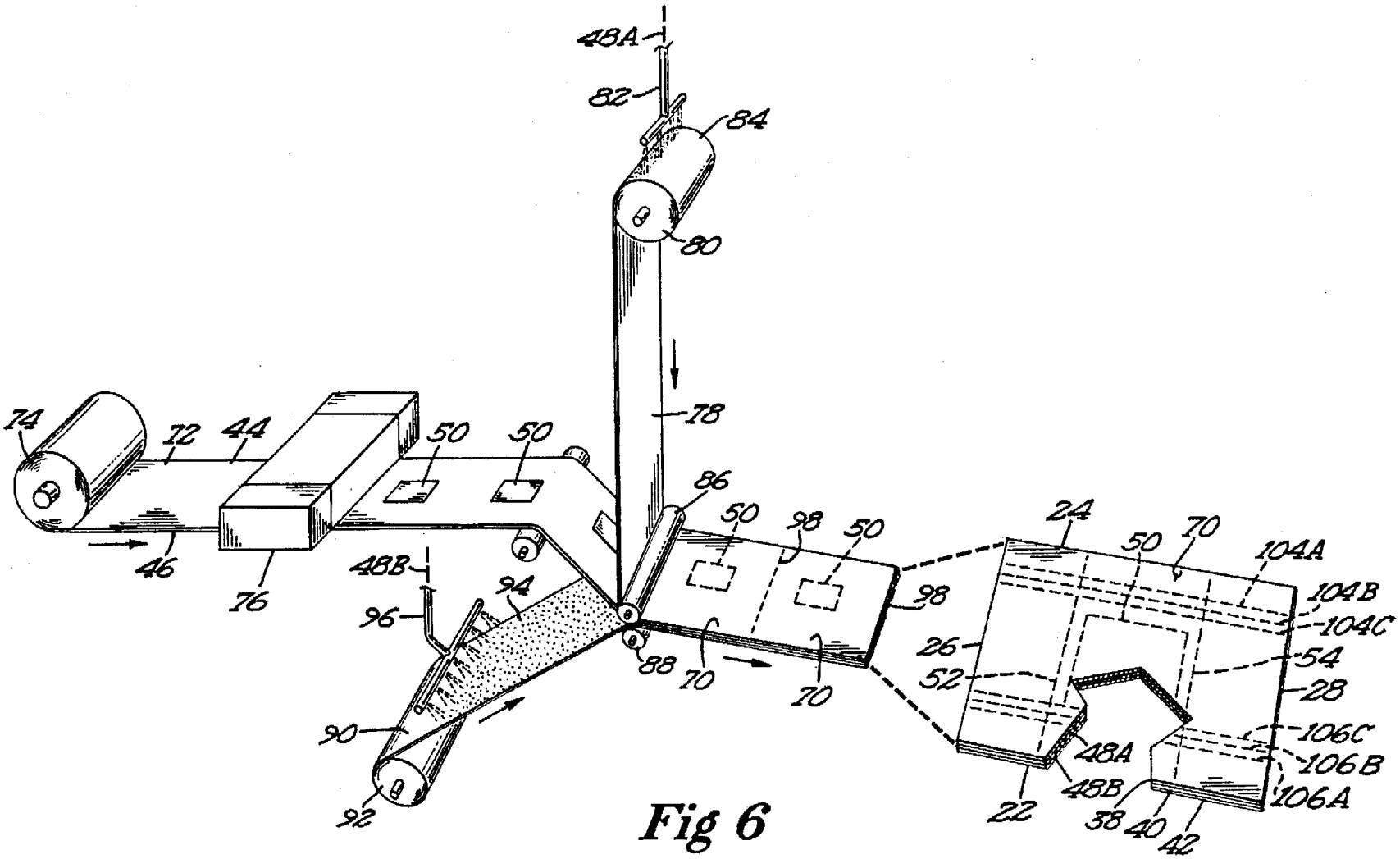
FIG. 6 is a perspective view illustrating a method for forming a microwaveable container blank of the invention.

Turning now to FIG. 6, a method is shown in simplified form for forming multiple container blanks 70. A first web 72 comprising a material impervious to liquid oil and moisture, as previously described, is dispensed from a first roll 74. The first web 72 comprises the middle layer 40 of the container wall 12, 14. The web 72 is shown as passing through a susceptor applicator 76 which typically applies a thin layer of e.g. aluminum by a known method to the interior face 44 of the web 72, forming spaced-apart susceptor patches 50 on the web.

A second web 78, comprising a fibrous material such as kraft paper or "greaseproof" paper, is dispensed from second roll 80 and has one face 84 partially or fully coated with an adhesive 48A by applicator 82. The face 84 of the second web 78, being coated with adhesive 48A, is joined to the interior face 44 of the first web 72 at rollers 86, 88, and the second web 78 becomes the inner layer 38 of the container blank 70.

A third web 90, comprising a fibrous material such as kraft paper, is dispensed from third roll 92. An adhesive 48B is applied to one face 94 by applicator 96 in a complete or partial manner, as previously discussed. Face 94 of the third web 90 is joined to the exterior face 46 of the first web 72 and the third web 90 becomes the outer layer 42 of the container blank 70. The laminate of webs 72, 78, 90 and receptor 50 is transversely cut along lines 98 to form multiple container blanks 70.

The finished container blank 70 is cut away to show the susceptor 50 as a metallic layer buried in the cohesive laminated structure, i.e. between the inner layer 38 and middle layer 40. Each of the layers 38, 40, 42 and 50 is shown greatly exaggerated in thickness.

To form the container 10 of FIG. 1, the blank 70 is folded along longitudinal fold lines 104A, 104B, 104C, 106A, 106B, and 106C. The alternate folding results in longitudinal gussets 16, 18 along opposite sides of the container (See FIG. 1). As illustrated in FIG. 1 the longitudinal edge portions 21 and 23 adjacent longitudinal edges 22 and 24, respectively, are typically joined into a seam 20 after the load 30 is inserted into the folded blank 70, although in some situations the seam 20 may be formed first and the load inserted from one end 26 or 28. Following the joining of the longitudinal edge portions 21, 23 and insertion of the load 30, the blank is typically folded along transverse fold lines 52 and 54 to form the container. Each end 26, 28 is then sealed with an adhesive in a manner to be described below.

If transverse adhesive strips 60, 62 are to be used, these are applied to the inside surface 64 of the blank 70 prior to folding.

Figure 7:
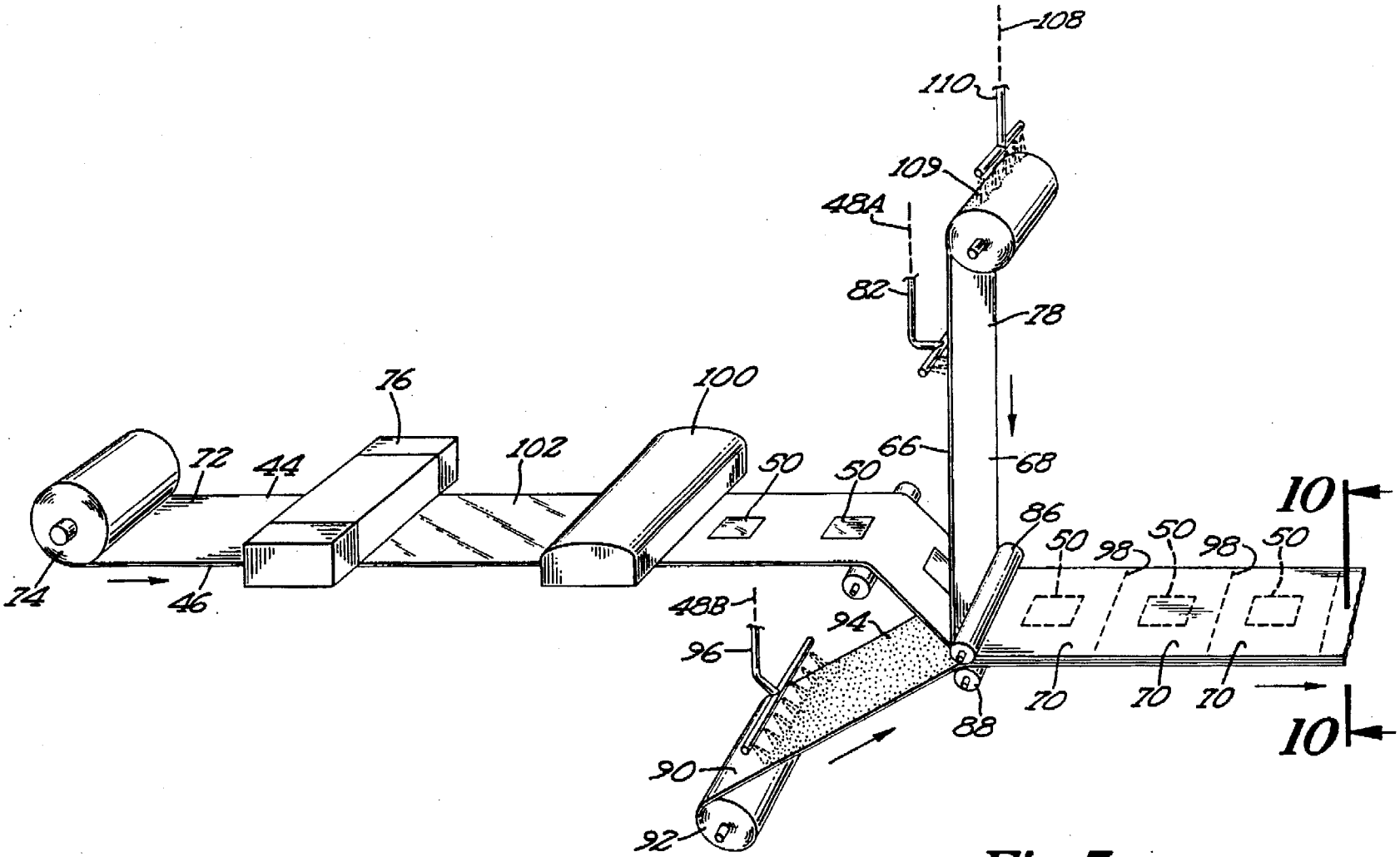
FIG. 7 is a perspective view illustrating a further method for forming a microwaveable container blank the invention.

FIG. 7 illustrates a variation in which the susceptor 50 is formed by first metallization by metallizer 76 of a major portion or all of the interior face 44 of the first web 72, and then demetallization of all of the metallized face 102 except the area or areas comprising the desired susceptor(s) 50. The demetallizer 100 may comprise an acid bath or other device as known in the art.

Also shown in FIG. 7 is an applicator 110 e.g. an extruder, coater roller or drum which optionally applies a sealant material 108 as a coating 109. The sealant material 108 may be Teflon polytetrafluoroethylene, a trademarked product of E. I. dupont & Company. Alternatively, the second web may alternatively be coated with Quilon werner type chromium complex, a trademarked product of E. I. duPont & Company. Other high melting point coatings may alternatively be applied to the second web 78. Alternative coatings of silicone and other emulsion state materials such as Saran polyester, a trademark of Dow, or other polymers. Such an application makes the inner layer 38 impervious (or nearly so, depending on the particular coating) to moisture and liquid oils. Although the sealant material 108 is shown as being applied to the exterior face 66 of the inner layer 38, it may alternatively be applied to the interior face 68. An adhesive 48A is shown being applied to the exterior face 66 by adhesive applicator 82 for joining the second web 78, i.e. the inner layer 38 to the first web 72, i.e. middle layer 40.

Where the inner layer 38 may be generally impervious to passage of oil and water on face areas, but may wick if exposed on the edges, it is desirable to apply the sealant material 108 to the edge potions only of the inner layer 38 to form the barrier. This may be done either before or after lamination with the middle layer 40.

Figure 8:
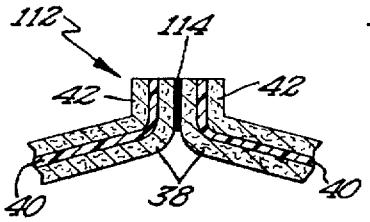
FIG. 8 is an enlarged cross-sectional end view of the longitudinal seam of a microwaveable container of the invention, as taken along line 8—8 of FIG. 1.

As shown in FIG. 8, the longitudinal seam 20 may be formed as a fin seal 112 in which edge portions of the inner layer 38 are joined by an adhesive 114. This type of seam is useful where the inner layer 38 is made impervious by application of a sealant material 108, or where the particular application does not require absolute sealing.

Figure 9:
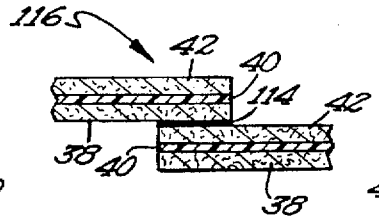
FIG. 9 an enlarged cross-sectional end view of a longitudinal seam of a further microwaveable container of the invention, as taken along line 8—8 of FIG. 1.

In an alternative arrangement, shown in FIG. 9, a lap seal 116 is formed by using adhesive 114 to join the inner layer 38 along one edge to the outer layer 42 of the other edge. This seal 116 is generally not as impervious as the fin seal 112, but may be useful in some applications.

Figure 11:
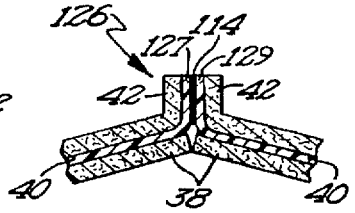
FIG. 11 is an enlarged cross-sectional end view of a longitudinal seam of another microwaveable container of the invention, as taken along line 8—8 of FIG. 1.
Figure 10:
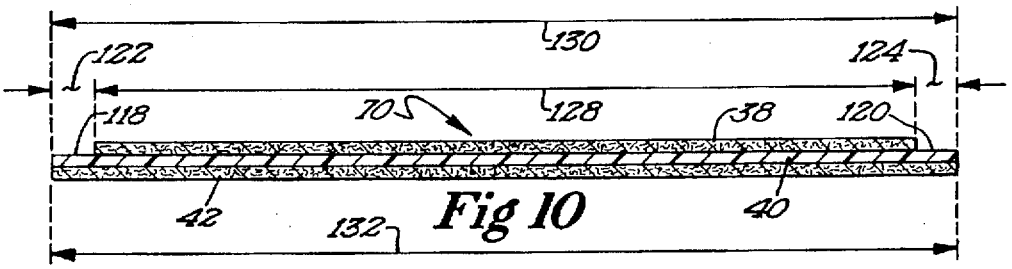
FIG. 10 is an exaggerated cross-sectional end view of a container blank of the invention, as taken along line 10—10 of FIG. 7.

In another aspect of container 10 shown in FIG. 10, the blank 70 is formed of a first web 72 having a width 130 greater than the width 128 of the second web 78. Thus, the first web 72 comprising the middle layer 40, is exposed for a relatively narrow width 122, 124, such as about 0.25 inch or up to about 0.7 inch, forming exposed strips 118, 120, along each longitudinal edge 22, 24, respectively. This enables the edges 127, 129 of the first web, i.e. impervious layer 40, to be joined to each other in a fin seal 126 as depicted in FIG. 11. The seal 126 may be formed with an impervious adhesive 114 or the edges 127 and 129 may alternatively be joined by thermal fusion and pressure. A combination of sealing methods may be used. This type of seal may be made essentially impervious to passage of moisture and oil, forming a container 10 which is tightly sealed against liquid oil, moisture, water vapor and gas transmission.

Figure 12:
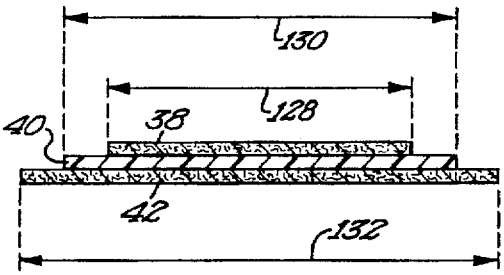
FIG. 12 an exaggerated cross-sectional end view of a further container blank of the invention, as taken along line 10—10 of FIG. 7.

The outer layer 42 may be made coextensive with the middle layer 40 as shown in FIG. 10, or may optionally have a width 132 which is greater or less than the width 130 of the middle layer 40. As depicted in FIG. 12, outer layer 42 has a greater width 132 than the width 130 of the middle layer 40. The longitudinal seam 20 may be formed as a fin seal 134 in which the edges 136, 138 of the outer layer 42 are joined by e.g. an adhesive 140 such as prior art adhesives useful for joining fibrous materials.

Figure 15:
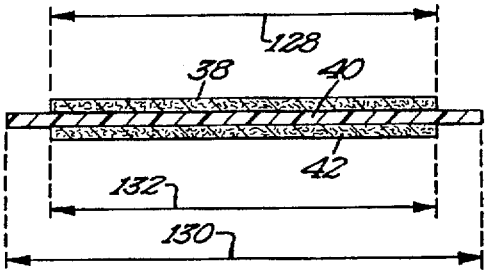
FIG. 15 is an exaggerated cross-sectional end view of another container blank of the invention, as taken along line 10—10 of FIG. 7.
Figure 13:
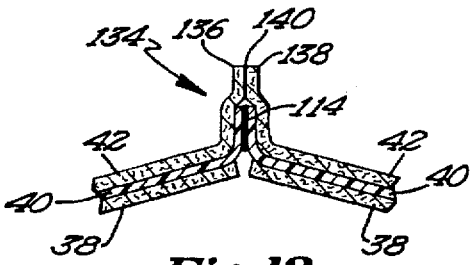
FIG. 13 is an enlarged cross-sectional end view of a longitudinal seam of a further microwaveable container of the invention, as taken along line 8—8 of FIG. 1.
Figure 14:
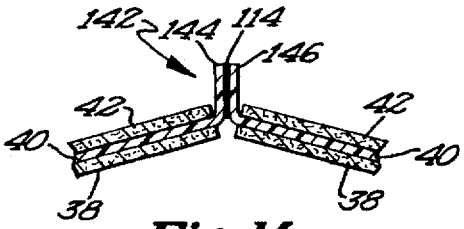
FIG. 14 is an enlarged cross-sectional end view of a longitudinal seam of another microwaveable container of the invention, as taken along line 8—8 of FIG. 1.

In FIGS. 14 and 15, the width 130 of the middle layer 40 is greater than either the width of the inner layer 38 or the width 132 of outer layer 42. When a fin seal 142 is used to form the longitudinal seam 20 (see FIG. 1 ), the edges 144, 146 of the middle layer 40 are exposed to the exterior of the finished container 10.

Figure 16:
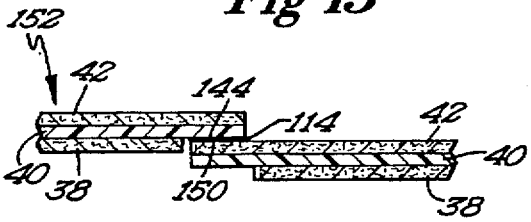
FIG. 16 an enlarged cross-sectional end view of a longitudinal seam of another microwaveable container of the invention, as taken along line 8—8 of FIG. 1.

As shown in FIG. 16, the container blank 70 of FIG. 10 may also be formed into a container 10 by joining the exposed edge 144 of the middle layer 40 with adhesive 114 to the edge 138 of the opposing outer layer 42 to form a seam 20 having a lap seal 152.

Figure 17:
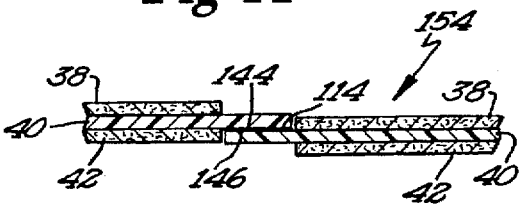
FIG. 17 is an enlarged cross-sectional end view of a longitudinal seam of a further microwaveable container of the invention, as taken along line 8—8 of FIG. 1.

As shown in FIG. 17, the container blank 70 of FIG. 15 may be formed into a container 10 by joining the exposed edges 144, 146 of the impervious layer 40 to each other by adhesive 114 or heat sealing to form a lap seal 154.

Figure 18:
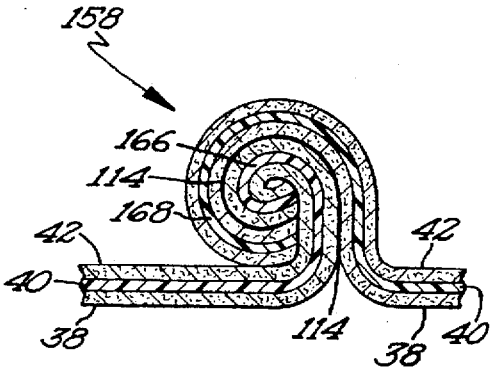
FIG. 18 is an enlarged cross-sectional end view of a longitudinal seam of another microwaveable container of the invention, as taken along line 8—8 of FIG. 1.

FIG. 18 illustrates a roll seal 158 in which the two edges 166, 168 are joined by adhesive or heat sealing and rolled, folded or crimped to enhance the strength of the resulting seam.

As further shown in FIG. 1, the ends 26 and 28 of the container 10 are also sealed. Any of the seals described above and shown in FIGS. 8, 9, 11, 13, 14 and 17 as being useful in a longitudinal seam 20 may also be used to close the ends 26 and 28.

The seal of the seam 20 may also comprise a lap of the edges 22, 24 which includes an adhesive 114 therebetween. The edges 22, 24 are then rolled or folded to form the seal 158.

Figure 19:
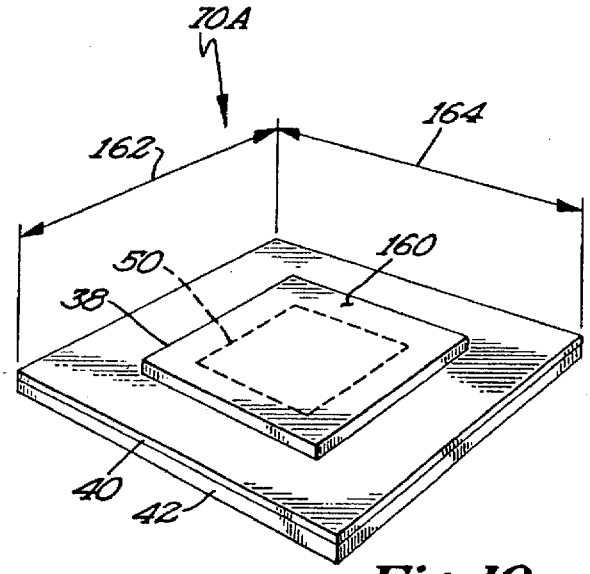
FIG. 19 is a perspective view of a further container blank of the invention.

The container 10 may be formed from a blank 70A in which the inner layer 38 is not longitudinally continuous with the middle layer 40. Such is shown in FIG. 19. Separate pieces of inner layer 38, i.e. pieces of "greaseproof" paper or kraft paper, or the like, are separately formed and joined to the first web 72 of middle layer 40. The pieces 160 of inner layer 38 are coated with an adhesive 48A and spacedly positioned on the first web 72. In this embodiment, each piece 160 is of a size which, at the least, completely covers the susceptor 50, but may be larger, e.g. as large as the third web 90. As shown, the exemplary blank 70A includes a piece 160 of inner layer 38 having width and length dimensions 162, 164 which are less than the width 162 and length 164 of the outer layer 42 formed from the third web 90.

Figure 20:
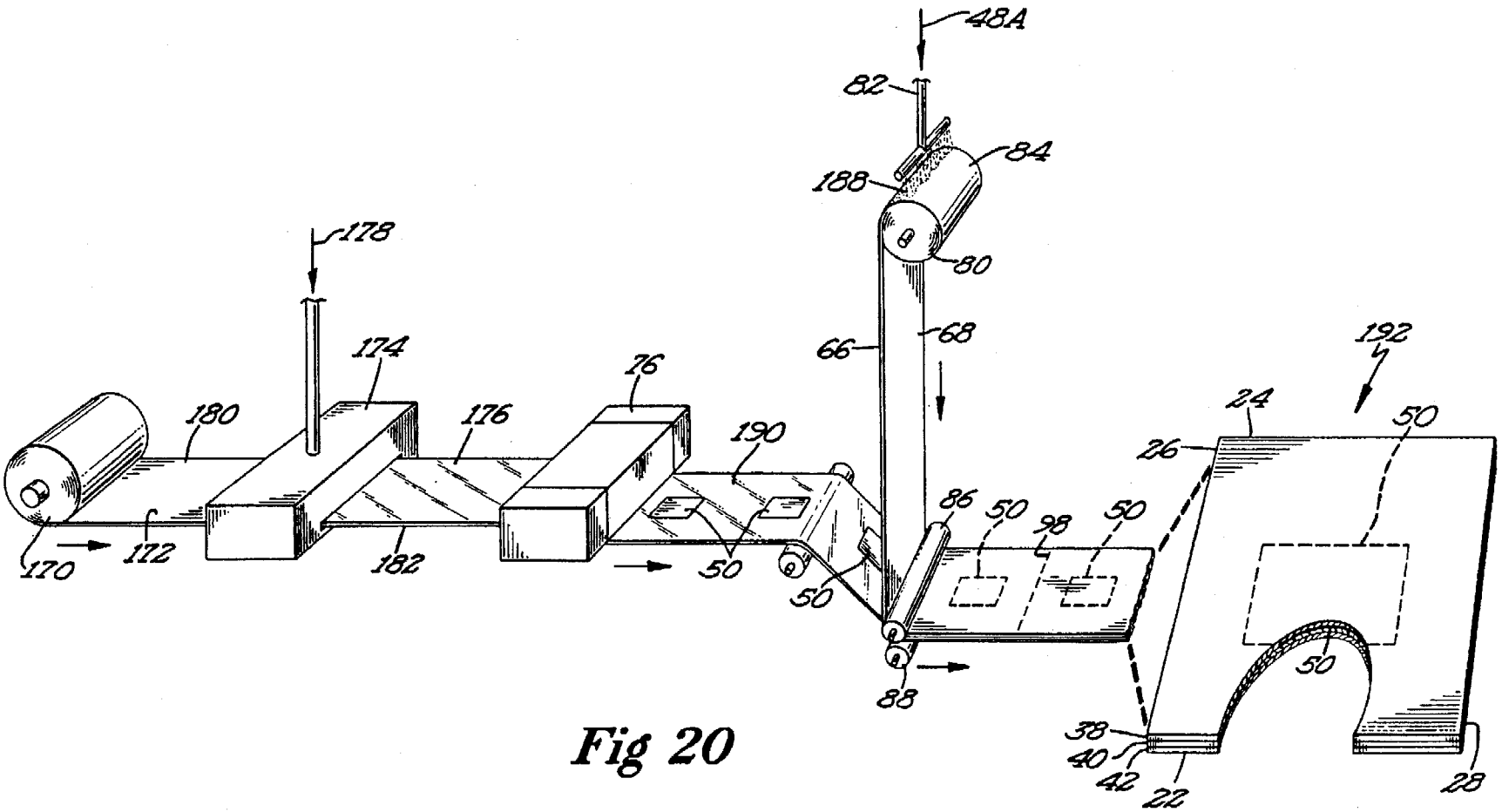
FIG. 20 is a perspective view illustrating a method for forming a microwaveable container blank of the invention.

In FIG. 20, an alternate method for forming a container blank 70 is shown. A first web of kraft paper or other thin planar material is dispensed from a first roll 170 to a plastic coating machine 174, in which a thin impermeable layer 176 of polymer resin or other material is rolled, printed, extruded, sprayed, or otherwise formed on the web surface 180, impregnating it and becoming bonded to it as it hardens. Such processes are well-known in the art. The material 178 may be Teflon polymer or Quilon material, both Dupont trademarks, or Saran (Dow trademark) or other polyester or silicone. The first web 172 becomes the outer layer 42 of the container, and the impermeable layer 176 becomes the middle layer 40. The plastic-paper laminate 182 is then passed through a susceptor applicator 76 for forming spaced-apart susceptors 50 on the laminate 182. A second web 184 of kraft paper, "grease-proof" paper or other fibrous material may be discharged from a second roll 186 and has one surface 188 coated, either totally or partially, with an adhesive material 48A from applicator 82 as previously described. The second web 184 with adhesive material 48A is joined to the plastic-paper-susceptor laminate 190, becoming the inner layer 38 and completing the container blank 70. As indicated previously, the blank 70 is cut into bag forming units 192 which are folded, filled with a load 30 and sealed.

Alternatively, the susceptor 50 is applied to web surface 180 before the application of polymer resin 178, or the susceptor 50 is applied to the exterior surface of the second roll 80 of fibrous material which forms the inner layer 38.

In a variant of the above process, the susceptor 50 is first applied to the kraft paper or "greaseproof" inner layer 38, followed by extrusion or other formation of a polyester film on the inner layer and impregnation of the polyester thereinto.

Figure 21:
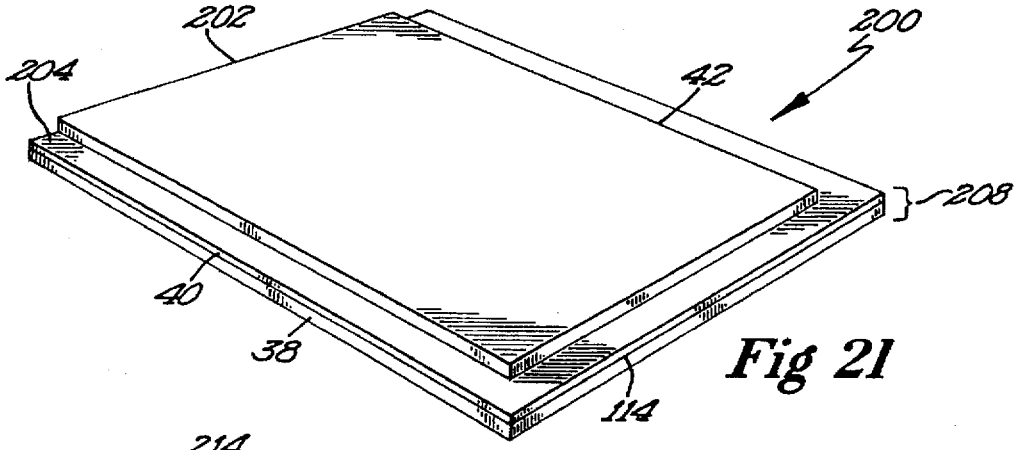
FIG. 21 is a perspective view of a pillow pouch formed from a microwaveable container blank of the invention.

Other types of containers may be formed from the various container blanks 70 as described herein. For example, the container may be formed without gussets. Alternatively, as shown in FIG. 21, A pillow pouch 200 without gussets may be formed from a unit 192 of the blank 70, by first folding the bag forming unit 192 in half along a central fold line 202 and then sealing the other sides using one of the methods previously described herein. As shown, the polyester middle layers 40 are exposed along their edges and the facing interior surfaces 206 of the edge portions 204 are joined in a fin seal 208 by adhesive 114. Alternatively, the sealing can be performed by heat and pressure. If desired, each of the layers 38, 40 and 42 may be coextensive and an adhesed seal between the facing inner layers 38 is produced.

Figure 22:
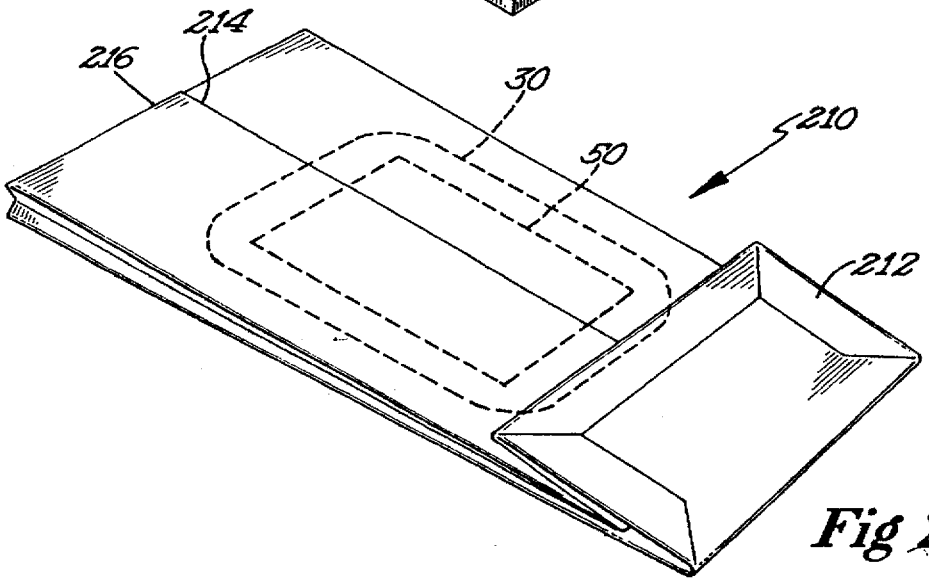
FIG. 22 is a perspective view of a square bottom bag formed from a microwaveable container blank of the invention.

A standard square bottom gusseted bag 210 may also be formed from a unit 192 of a blank 70, as depicted in FIG. 22. Such bag shape is common in the art, but the formation of such a bag with microwaveable walls impermeable to moisture, water vapor, liquid oils, and gases provides particular advantages. A bag 210 with gussets 218 and with a square bottom 212 provides considerable expansion room, and the longitudinal seam 214 may be formed as previously described. The top portion 216 is sealed by any of the methods already shown herein. A susceptor 50 and a load 30 may be placed in the bag 210 between the square bottom 212 and the top portion 216.

While the container is shown herein as having generally rectangular sides, the container may be formed in any shape which is sealable to form an impermeable enclosure about the container contents.

In the prior are packaging of microwave popcorn, hydrogenated oils are used. The oil is typically heated to about 115–150 degrees F. to melt it to a flowable state. The melted oil and popcorn are then deposited in the microwave bag. In any case, the heating of the corn by the hot oil results in a loss of kernel moisture and loss of expansion upon popping.

Oils are more polar in the liquid state than when solidified. During popping in a microwave oven, liquid oils absorb a greater fraction of the microwave energy than do solid oils, reaching the popping temperature in a shorter time. Thus, in the microwaveable container of this invention as described above, less oil is required, less energy is required in the packaging process, and the popping occurs in a shorter heating time. In addition, a greater expansion may occur than when using solidified oils, apparently because the shorter heating time results in less dehydration of the kernels.

The container is adaptable for packaging essentially any material which is to be heated by microwave energy. It is particularly useful for microwave popcorn and the like, and prevents the loss of moisture, water vapor, flavorings and oils.

It is anticipated that various changes and modifications may be made in the construction, arrangement, operation and method of construction of the microwaveable container disclosed herein without departing from the spirit and scope of the invention as defined in the following claims.

What is claimed is:

1. A microwaveable container for heating material with microwave radiation, said container containing:

a bag formed of a three layer laminate comprising:

a middle layer comprising microwaveable non-reactive plastic impervious to liquid oils and moisture, said middle layer having an inner surface and an outer surface and opposing side edges;

an inner layer of fibrous material having an outer surface positioned adjacent the inner surface of said middle layer, an inner surface for contact with a food product, and having opposing side edges;

a coating of sealant material on said inner layer, said coating impervious to water, water vapor, and liquid oils; and an outer layer of fibrous material positioned adjacent the outer surface of said middle layer and having opposing side edges;

wherein said middle layer is joined to one of said inner layer and said outer layer;

and whereby said laminate formed of said three layers has longitudinal side edges folded and sealed to each other to form a longitudinal seam.

2. The microwaveable container of claim 1, wherein said middle layer is joined by an adhesive to one of said inner layer and said outer layer.

3. The microwaveable container of claim 1, wherein said middle layer is joined by an adhesive to one of said inner layer and said outer layer along the periphery thereof.

4. The microwaveable container of claim 1, wherein said middle layer is joined by an adhesive to both of said inner layer and said outer layer.

5. The microwaveable container of claim 1, wherein said laminate further comprises a plurality of transverse fold lines dividing said container into a central portion and opposing end portions.

6. The microwaveable container of claim 5, further comprising material to be heated positioned in said central portion of the container between said end portions, and wherein each end portion is sealed shut.

7. The microwaveable container of claim 6, wherein one of said longitudinal seam and said sealed end portions is one of rolled, folded and crimped.

8. The microwaveable container of claim 1, including at least one longitudinal gusset.

9. The microwaveable container of claim 1, wherein at least a portion of said inner layer is coated with a water, water vapor and liquid oil impermeable material comprising one of polytetrafluoroethylene, polyester, silicone, and werner type chromium complex.

10. The microwaveable container of claim 9, wherein said coating of material impervious to water, water vapor and liquid oil impregnates at least a portion of said inner layer.

11. The microwaveable container of claim 1, further comprising a microwave sensitive susceptor positioned between the middle layer and one of the inner layer and outer layer of the container, proximate one side of the material to be heated.

12. The microwaveable container of claim 11, wherein said susceptor is affixed to one of an exterior face of the inner layer and an interior face of said outer layer.

13. The microwaveable container of claim 11, wherein said susceptor comprises a metallized film.

14. The microwaveable container of claim 1, wherein said middle layer, inner layer and outer layer are coextensive.

15. The microwaveable container of claim 1, wherein said longitudinal side edges are joined by an adhesive between the outer layer of one side edge and the inner layer of the other side edge in a lap joint.

16. The microwaveable container of claim 1, wherein said longitudinal side edges are joined by an adhesive between the inner layer of one side edge and the inner layer of the other side edge in a fin seal.

17. The microwaveable container of claim 1, wherein each said end portion is sealed by an adhesive between the outer layer of one side and the inner layer of the other side.

18. The microwaveable container of claim 1, wherein each said end portion is sealed by an adhesive between corresponding inner layers.

19. The microwaveable container of claim 1, wherein the side edges of said middle layer extend outwardly from the side edges of said inner layer and said outer layer of the laminate.

20. The microwaveable container of claim 1, wherein said side edges of said middle layer are joined to each other by an adhesive in a lap joint.

21. The microwaveable container of claim 1, wherein said side edges of said middle layer are joined to each other by said adhesive in a fin seal.

22. The microwaveable container of claim 1, wherein said side edges of said middle layer are joined to each other by a heat sealing process.

23. The microwaveable container of claim 1, wherein the side edges of said middle layer extend outwardly from the side edges of said inner layer.

24. The microwaveable container of claim 1, wherein a side edge of a middle layer is joined to a side edge of an inner layer by adhesive in a lap joint.

25. The microwaveable container of claim 1, wherein a side edge of a middle layer is joined to a side edge of an outer layer by adhesive in a lap joint.

26. The microwaveable container of claim 1, wherein said middle layer is comprised of polyester.

27. The microwaveable container of claim 1, wherein said middle layer is comprised of Mylar polyethylene terephthalate.

28. The microwaveable container of claim 1, wherein said inner layer comprises one of kraft paper and rolled greaseproof paper.

29. The microwaveable container of claim 1, wherein said material impervious to water, water vapor and liquid oil is coated on the outer surface of said inner layer.

30. An elongated laminated sheet for fabricating a plurality of microwaveable containers for leakproof storage of material containing liquid oil, said laminated sheet comprising:

an outer layer comprising a fibrous material, said outer layer having an inside surface and an outside surface with opposed side edges;

a middle layer comprising a film of plastic material impervious to liquid oil, said middle layer having an inside surface and an outside surface with opposed side edges;

an inner layer comprising a fibrous material, said inner layer having an inside surface and an outside surface with opposed side edges, at least a portion of one of said inside and outside surfaces coated with a sealant impervious to water, water vapor, and liquid oil; and a first adhesive interposed between at least portions of said outside surface of said inner layer and the inner surface of said middle layer to join said inner layer to said middle layer;

wherein said laminated sheet is formed in a roll to be transversely cut into discrete portions for fabricating individual containers.

31. The laminated sheet of claim 30, further comprising a second adhesive interposed between at least portions of said inside surface of said outer layer and the outside surface of said middle layer to join said middle layer to said outer layer.

32. The laminated sheet of claim 30, further comprising a plurality of microwave susceptor patches between said middle layer and one of said inner layer and said outer layer for generating heat upon application of microwave radiation.

33. The laminated sheet of claim 30, wherein said middle layer comprises polyester.

34. The laminated sheet of claim 30, wherein said middle layer comprises polyethylene terephthalate.

35. The laminated sheet of claim 30, wherein at least a portion of said inner layer is impregnated with said sealant material comprising polytetrafluoroethylene, polyester resin, silicone, and werner type chromium complex.

36. The laminated sheet of claim 30, wherein the distance between the opposed longitudinal edges of the inner layer is less than the distance between the opposed longitudinal edges of the middle layer, to expose said middle layer along each longitudinal edge.

37. The laminated sheet of claim 30, wherein the distance between the opposed end edges of the inner layer is less than the distance between the opposed end edges of the middle layer.

38. The laminated sheet of claim 30, wherein the distance between the opposed longitudinal edges of the inner layer and the distance between the opposed longitudinal edges of the outer layer are each less than the distance between the opposed longitudinal edges of the middle layer, to expose the middle layer proximate the opposed longitudinal edges thereof on the inside and outside surfaces thereof.

39. A microwaveable popcorn package for non-refrigerated storage, comprising:

a bag formed of a continuous layer of plastic impervious to liquid oil, water vapor, moisture and gas, said layer of plastic having an interior surface and an exterior surface with opposed side edges and opposed end edges, said opposed side edges joined to each other and each end edge sealed to itself;

an inner layer of fibrous material joined to a portion of the interior surface of the plastic layer with a first adhesive, at least a portion of said inner layer including an impregnating coating of a sealant material impervious to water, water vapor, and liquid oil;

a microwave susceptor between the layer of plastic and the inner layer;

an outer insulative layer joined to at least a portion of the exterior surface of the plastic layer with a second adhesive; and a plurality of popcorn kernels on the inner layer within the bag.

40. The microwaveable popcorn package of claim 39, wherein said sealant material comprises one of polytetrafluoroethylene, polyester resin, silicone, and werner type chromium complex.

41. The microwaveable popcorn package of claim 39, further comprising a third adhesive joining said opposed side edges to each other and each end edge to itself.

42. The microwaveable popcorn package of claim 39, wherein said edges are joined by heat fusion.

43. The microwaveable popcorn package of claim 39, further comprising an oil in contact with said popcorn kernels.

44. A method for making a laminated sheet for a microwaveable container, comprising the steps of:

passing a first web of plastic impervious to liquid oils, water vapor, moisture, oxygen and organic flavorings to a suspector applicator wherein spaced-apart susceptors are applied to a first surface of said first web, said first web having an opposing second surface;

applying an impregnating sealant material to at least a portion of a second web;

joining said second web of fibrous material with adhesive to at least portions of said first surface to overcover said susceptors; and joining a third web of fibrous material with adhesive to at least portions of said second surface of said first web.

45. The method of claim 44, wherein said susceptors comprise metallized film applied by metal vaporization.

46. The method of claim 44, wherein said susceptors are formed by metallizing a surface of said first web and then removing a portion of said metallized surface whereby the remaining portions comprise said susceptors.

47. The method of claim 44, wherein said sealant material comprises one of silicone, polytetrafluoroethylene, polyester, and werner type chromium complex.

48. A method for making a laminated sheet for a microwaveable container, comprising the steps of:

applying polyester resin to a first web of fibrous material to form a first surface impervious to oils, water, water vapor, oxygen and organic flavorings;

passing said first web to a susceptor applicator wherein spaced-apart susceptors are formed on a first surface of said first web, said first web having an opposing second surface;

applying an impregnating sealant material to at least a portion of a second web of fibrous material; and joining said second web of fibrous material with adhesive to at least portions of said first surface to overcover said susceptors.

49. The method of claim 48, wherein the susceptors are formed on the first web prior to applying said polyester resin.

50. The method of claim 48, wherein the susceptors are formed on the layer of polyester applied to the first web.

51. The method of claim 48, wherein said sealant material comprises one of silicone, polytetrafluoroethylene, polyester, and werner type chromium complex.

* * * * *